United States Patent [19]

Höllrigl et al.

[11] Patent Number: 4,797,164

[45] Date of Patent: Jan. 10, 1989

[54] PROCESS FOR MANUFACTURING A FINE-GRAINED RECRYSTALLIZED SHEET

[75] Inventors: Günter Höllrigl; Pedro Rodrigues, both of Schaffhausen, Switzerland

[73] Assignee: Swiss Aluminum Ltd., Chippis, Switzerland

[21] Appl. No.: 99,746

[22] Filed: Sep. 22, 1987

[30] Foreign Application Priority Data

Sep. 30, 1986 [CH] Switzerland ..... 3908/86

[51] Int. Cl.[4] ..... C22F 1/04

[52] U.S. Cl. ..... 148/2; 148/3; 148/12.7 A; 148/159; 420/902

[58] Field of Search ..... 148/11.5 A, 12.7 A, 148/159, 2, 3; 420/902

[56] References Cited

U.S. PATENT DOCUMENTS 4,528,042 7/1985 Ward et al. ..... 148/12.7 A

*Primary Examiner*—R. Dean

*Attorney, Agent, or Firm*—Bachman & LaPointe

[57] ABSTRACT

In a process for manufacturing a fine-grained recrystallized sheet of heat-treatable i.e. age-hardenable aluminum alloy containing an addition of at least one of the elements Ti, Zr, Hf, V, Nb, Ta, Cr, Mo, W amounting in total to 0.08–1.50%, the alloy is brought into a condition A in which the alloying elements that lead to age-hardening and the above mentioned additive elements are, at least for the greater part, in solid solution, following which in step B the incoherent hardening phases are precipitated out in a temperature range between the solvus $T_{gps}$ and the solvus $T_s$, and in a subsequent step C the aluminides of the above mentioned elements are precipitated as a very dense uniform dispersion by heating in a temperature range between 300° C. and $T_s$-30° C., whereby any deformation by rolling may take place between condition A and step C at temperatures not higher than $T_s$-30° C., and in which process the temperature of the sheet below a thickness or 2.5 xd does not exceed 200° C., and the sheet at thickness d is heated to a recrystallization treatment D such that the heating rate is at least 20° C./s until above the recrystallization threshold.

2 Claims, 1 Drawing Sheet

1 μm

1 μm

PROCESS FOR MANUFACTURING A FINE-GRAINED RECRYSTALLIZED SHEET

BACKGROUND OF THE INVENTION

The invention relates to a process for manufacturing a fine-grained recrystallized sheet that is suitable for superplastic forming made of heat-treatable i.e. age-hardenable aluminum alloy.

The aluminum alloys that qualify as age-hardenable are those with which an increase in strength can be achieved by heat treatment, in contrast to those with which this can be achieved only by cold forming. Alloys of the age-hardenable type include in particular the AlMgSi, AlCuMg, AlCuMgSi, AlZnMg, AlZnMgCu and Li-containing varieties. In these alloys, there is a tendency to form coarse grain if the solution treatment that is necessary for the age-hardening process is associated with recrystallization. For very many applications, especially for superplastic forming, a fine-grained structure is desired or a basic prerequisite. For that reason, sheet materials that should be deformed superplastically are required to have a grain-size of less than 25 μm, preferably less than 10 μm. Furthermore, the grains should be almost equiaxed. In addition, no significant coarsening of the grains should occur during the superplastic deformation which is performed at about 500° C.

A number of process proposals are known for the manufacture of superplastically formable sheet of age-hardenable aluminum alloys. The following process, for example, is known from the U.S. Pat. No. 4,528,042:

Solution treatment of a cast ingot above 460° C., cooling at 11° C./h to 56° C./h to 315°–370° C., hot rolling with a starting temperature between 315° and 370° C. and a finishing temperature below 315° C., cooling to 93°–232° C., hot rolling at low temperatures to final thickness and finally rapidly recrystallize.

This and similar processes have, however, with respect to the resultant grain-size, in particular during superplastic forming, proved to be very sensitive to small variations in the alloy composition and to other process parameters.

SUMMARY OF THE INVENTION

The object of the invention is therefore to develop a process which can be employed with all age-hardenable types of aluminum alloys with a high degree of certainty and broad tolerance with respect to non-specified process parameters, and leads to a fine grained, recrystallized sheet that is suitable for superplastic forming.

This object is achieved by way of the present invention in that the alloy employed contains an addition of at least one of the elements Ti, Zr, Hf, V, Nb, Ta, Cr, Mo, W having a total concentration of 0.08–1.5 wt %, and that the alloy is brought into a condition A in which both the alloying elements that lead to age-hardening and the above mentioned additive elements are at least for the greater part in solid solution, following which in step B the incoherent hardening phases are precipitated out in a temperature range between the solvus $T_{gps}$ and the solvus $T_s$, and in a subsequent step C, the aluminides of the above mentioned elements are precipitated as a very dense uniform dispersion by heating in a temperature range between 300° C. and $T_s-30°$ C., whereby any deformation by rolling may take place between condition A and step C at temperatures not higher than $T_s-30°$ C., that the temperature of the sheet below a thickness of $2.5\times d$ does not exceed 220° C., and that the sheet at a thickness d is heated to a recrystallization treatment D such that the heating rate is at least 20° C./s until above the recrystallization threshold.

BRIEF DESCRIPTION OF THE DRAWINGS

The present invention will be more readily understandable from a consideration of the accompanying drawings wherein.

DETAILED DESCRIPTION

Figure 1:
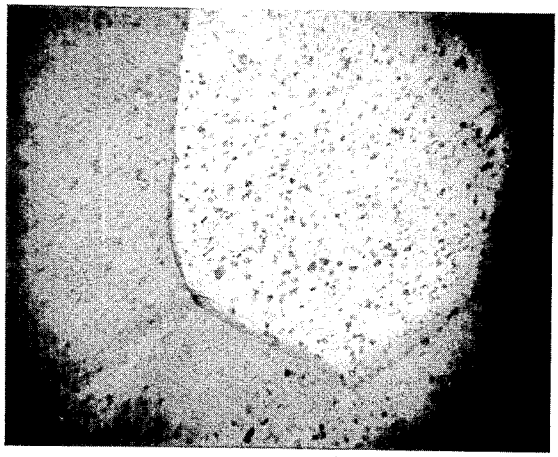
FIG. 1 is an electron micrograph at a magnification of 10,000× of a material processed in accordance with the present invention.

On selecting the amount of the above mentioned additive elements, care must be taken to prevent coarse primary particles forming during casting. Accordingly, the range up to the upper limit of 1.5 wt % can be fully exploited only by adequately fast solidification. The amount of additive elements according to the invention can be already present, in part or in whole, in the selected age-hardenable alloy, as laid down in the standard for that alloy.

Step B can be performed not only as heat-treatment in the temperature range $T_{gps}$–$T_s$, but also in the form of a rolling operation in which the starting temperature is below $T_s-30°$ C. and the finishing temperature is above $T_{gps}$, or also as a combination of such heat-treatments and rolling operations. Likewise, step B can be designed as a holding stage on heating up to step C.

The characteristic temperatures $T_s$ and $T_{gps}$ are known for all common alloys; in all cases, $T_{gps}$ is below 180° C. and $T_s$ is for example:

| AA Alloys | $T_s$ |
|---|---|
| 2024 | 485° C. |
| 6062 | 520° C. |
| 7475 | 460° C. |

The equilibrium phases precipitated out in step B (in particular $Al_2Cu$ in the 2xxx-, $Mg_2Si$ in the 6xxx- and $MgZn_2$ in the 7xxx-alloys) are uniformly, densely distributed as 0.5–2 μm large particles. The interfaces these particles have with the aluminum matrix form nucleation sites at the start of step C for the precipitation of the aluminides of the additive elements from groups IV B to VI B. As a result, one obtains a dense network of these aluminide precipitates. The precipitated equilibrium phases themselves subsequently coarsen. The duration of the heat-treatment in step C, and the temperature within the above mentioned range of 300° C. to $T_s-30°$ C. is preferably to be selected such that the aluminides of the additive elements are precipitated out as much as is possible; the optimum temperature is a function of the solubility of the aluminide in the aluminum lattice and the diffusivity of the particular additive element. If Cr is selected as the additive, then the preferred temperature for the heat-treatment in step C is, provided the $T_s$ of the alloy in question permits, about 380°–420° C. In the case of Zr the corresponding temperature is about 350°–380° C.

The final rolling to end thickness d is to be, at least in a last phase, in the form of cold rolling from a thickness of 2.5 times the end thickness, whereby temperatures of up to 220° C. can be tolerated.

The recrystallization treatment D is as a rule a heat-treatment, preferably in a continuous heat-treatment furnace. At least from 220° C. up to the temperature at which the recrystallization threshold is exceeded, the heating rate must amount to at least 20° C./s. The recrystallization treatment D can, however, also be integrated in a hot forming operation; the same heating rate specification, however, must be observed.

The process according to the invention results in an almost equiaxed grain structure with an average intercept area of about 25 $\mu m^2$ to hardly more than 100 $\mu m^2$ per grain, and this over the whole range of sheet thickness from 0.5 mm to 5 mm.

With regard to the fine grain structure of the product, a particularly suitable way of converting the alloy into condition A according to the invention is to solidify the alloy rapidly. In doing so, the time interval lapsing between the liquidus and the solidus should not exceed 5 s. Suitable for that purpose are for example casting rolls, powder metallurgy processes or melt spinning.

Further advantages, features and details of the invention are revealed in the following description of preferred exemplified embodiments.

EXAMPLE NO. 1

A 350 mm thick rolling ingot of alloy AA 7475 having 5.6% Zn, 2.2% Mg, 1.5% Cu, 0.20% Cr, 0.07% Si, 0.10% Fe and 0.05% Ti was cast using an electromagnetic mold. After a 2 stage homogenization comprising 3 hours at 470° C. and 10 hours at 485° C. (condition A), the ingot was heated for hot rolling to a starting temperature of 400° to 450° C. The 9 mm thick hot rolled strip was coiled at 320°–380° C. and cooled at a rate of about 20° C./h to below 150° C. (step B). The coil was then heated for 8 hours at 390°–400° C. and cooled in still air (step C). The 9 mm thick strip was cold rolled to a final tickness of 2 mm. In the process of cold rolling the strip reaches a temperature of at most 150° C. The coil was then passed through a continuous heat treatment furnace in which the metal was heated within 20 s to 475° C., held at this temperature for 190 s and subsequently rapidly cooled (treatment D).

Figure 2:
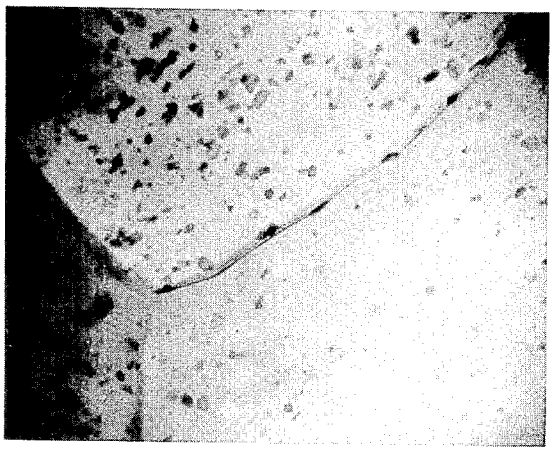
FIG. 2 is an electron micrograph at a magnification of 16,000× of a material processed in accordance with the present invention.

The sheet exhibited an average area per sectioned grain of 32 $\mu m^2$, determined by optical microscopy on a prepared section. An electron micrograph (TEM) of the same material in the same condition, shows the resultant structure in FIG. 1 at a magnification of 10,000 times and in FIG. 2 at a magnification of 16,000 times. There, one can see the finely dispersed distribution of the aluminides, mainly the ternary phase $Al_{18}Mg_3Cr_2$. The particles are about 0.03–0.5 $\mu m$ in diameter and are on average spaced about 0.5 $\mu m$ apart. As can be seen in particular in FIG. 2, they stabilize the grain boundaries and thus prevent grain coarsening during subsequent hot forming.

The 2 mm thick sheet was subsequently successfully formed into shaped parts at 500° C. at a strain rate of $10^{-3}$/s. No grain coarsening could be detected.

EXAMPLE 2

Using the same alloy as in example No. 1, an 8 mm thick strip was cast on a CASTER 1 type of roll caster at a casting speed of 9 mm/s (condition A). The strip was coiled at 270° C. and cooled to 150° C. over 4 hours (step B). After a first cold rolling to 5 mm, the alloy was heat-treated as a coil for 8 hours at 400° C. (step C). Subsequently, the strip was cold rolled to an end thickness of 1.2 mm and recrystallized as in exaple No. 1 (treatment D).

This resulted in an average area per sectioned grain of 70 $\mu m^2$.

EXAMPLE 3

The alloy in example No. 1 was cast on a roll caster as a 7 mm thick strip (condition A). This was coiled at 260° C. and cooled to 150° C. within 4 hours (step B). The coil was heated to 400° C. within a period of 6 hours and held at this temperature for 8 hours (step C). The strip was then cold rolled to a final thickness of 1.2 mm and finally annealed in the continuous heat-treatment furnace at 475° C. for 170 s after a 16 s heating up period (treatment D).

This resulted in an average area per sectioned grain of 28 $\mu m^2$.

Strips of the sheet were superplastically stretched at 490° C. at 0.8 mm/minute. The resultant elongation at fracture amounted to 640% of the initial length of 20 mm.

What is claimed is:

1. Process for manufacturing a fine-grained recrystallized sheet that is suitable for superplastic forming made of an age-hardenable aluminum alloy, which comprises: providing an aluminum base alloy consisting essentially of at least one age hardening additive and an addition selected from the group consisting of the elements Ti, Zr, Hf, V, Nb, Ta, Cr, Mo, W, and mixtures thereof having a total concentration of 0.08–1.5 wt %; bringing the alloy into a condition A in which both the alloying elements that lead to age-hardening and the addition elements are at least for the greater part in solid solution; precipitating out in step B the incoherent hardening phases in a temperature range between the solvus $T_{gps}$ and the solvus $T_s$; and precipitating in a subsequent step C the aluminides of the above mentioned elements as a very dense uniform dispersion by heating in a temperature range between 300° C. and $T_s-30°$ C., whereby any deformation by rolling may take place between condition A and step C at temperatures not higher than $T_s-30°$ C., and in which process the temperature of the sheet below a thickness of $2.5\times d$ does not exceed 200° C.; and heating the sheet at a thickness d to a recrystallization temperature D such that the heating rate is at least 20° C./s until above the recrystallization threshold.

2. Process according to claim 1, wherein the alloy is put into condition A by solidifying such that the time interval lapsing between the liquidus and the solidus is at most 5 s.

* * * * *